US010787284B2

(12) United States Patent
Wetsch et al.

(10) Patent No.: US 10,787,284 B2
(45) Date of Patent: Sep. 29, 2020

(54) IDLER ROLLER

(71) Applicant: PREGIS INNOVATIVE PACKAGING LLC, Deerfield, IL (US)

(72) Inventors: Thomas D. Wetsch, St. Charles, IL (US); Paul F. Ostwald, Queensbury, NY (US); William James Watts, Tinley Park, IL (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 583 days.

(21) Appl. No.: 15/472,123

(22) Filed: Mar. 28, 2017

(65) Prior Publication Data

US 2017/0275033 A1 Sep. 28, 2017

Related U.S. Application Data

(60) Provisional application No. 62/314,209, filed on Mar. 28, 2016.

(51) Int. Cl.
*B65B 51/26* (2006.01)
*B65B 51/22* (2006.01)
(Continued)

(52) U.S. Cl.
CPC ..... *B65B 51/26* (2013.01); *B31D 5/0073* (2013.01); *B65B 9/20* (2013.01); *B65B 51/222* (2013.01);
(Continued)

(58) Field of Classification Search
CPC .. B31D 5/0073; B31D 5/0039; B31D 5/0052; B31D 5/0065; B31D 5/0078; B65B 9/20; B65B 51/26
(Continued)

(56) References Cited

U.S. PATENT DOCUMENTS 4,017,351 A * 4/1977 Larson ..... B29C 49/0047 156/494
5,906,569 A * 5/1999 Ratzel ..... B26D 1/245 493/363
(Continued)

OTHER PUBLICATIONS

International Search Report and Written Opinion, issued in PCT Application No. PCT/US2017/024626 dated Jun. 16, 2017, 8 pages.

*Primary Examiner* — Nathaniel C Chukwurah
*Assistant Examiner* — Lucas E. A. Palmer
(74) *Attorney, Agent, or Firm* — Fox Rothschild LLP

(57) ABSTRACT

An inflatable-cushion inflation and sealing device is provided. The device includes an inflation assembly that inflates with a fluid a cushion cavity disposed between overlapping portions of first and second plies of a film, which plies form a flexible structure. The device also includes a sealing mechanism having a first compression element having a curved surface operable to bend the flexible structure about a bend axis, a second compression element positioned such that the first and second compression elements are operable to receiving the flexible structure at a first pinch area in which the first compression element and the second compression element are positioned against the flexible structure to pinch the flexible structure, and a third compression element configured for receiving the flexible structure at a second pinch area in which the first compression element and the third compression element contact the flexible structure.

30 Claims, 11 Drawing Sheets

(51) Int. Cl.
*B65B 9/20* (2012.01)
*B31D 5/00* (2017.01)

(52) U.S. Cl.
CPC .... *B65B 51/225* (2013.01); *B31D 2205/0023* (2013.01); *B31D 2205/0047* (2013.01); *B31D 2205/0064* (2013.01); *B31D 2205/0082* (2013.01)

(58) Field of Classification Search
USPC ..... 53/79
See application file for complete search history.

(56) References Cited

U.S. PATENT DOCUMENTS 6,015,047 A 1/2000 Greenland
6,371,902 B1 * 4/2002 Bluemle ..... B31B 50/00 493/370
6,423,166 B1 7/2002 Simhaee
6,460,313 B1 * 10/2002 Cooper ..... B31D 5/0073 53/493
6,605,169 B2 * 8/2003 Perkins ..... B31D 5/0073 156/147
6,751,926 B1 * 6/2004 Cooper ..... B31D 5/0073 53/558
6,800,162 B2 * 10/2004 Kannankeril ..... B29C 65/18 156/145
7,328,541 B2 * 2/2008 Garceau ..... B29C 65/18 226/196.1
7,913,474 B2 * 3/2011 Aquarius ..... B31D 5/0073 493/314
7,950,433 B2 5/2011 Sperry et al.
8,061,110 B2 * 11/2011 Wetsch ..... B31D 5/0073 53/403
8,128,770 B2 3/2012 Wetsch et al.
8,402,719 B2 * 3/2013 Birkle ..... B31D 5/0073 493/967
8,991,141 B2 * 3/2015 Sperry ..... B31D 5/0073 53/403
2004/0099986 A1 5/2004 Kannankeril et al.
2005/0172576 A1 8/2005 Matsunaga et al.
2006/0042184 A1 * 3/2006 Perkins ..... B31D 5/0073 53/79
2006/0174589 A1 * 8/2006 O'Dowd ..... B31D 5/0073 53/79
2006/0218880 A1 10/2006 Sperry et al.
2008/0066852 A1 * 3/2008 Wetsch ..... B29C 65/18 156/147
2009/0094938 A1 4/2009 Biertnat et al.
2010/0200169 A1 * 8/2010 Sperry ..... B31D 5/0073 156/495
2011/0072765 A1 * 3/2011 Salerno ..... B29C 44/182 53/562
2011/0172072 A1 7/2011 Wetsch et al.
2014/0261752 A1 * 9/2014 Wetsch ..... B65B 41/16 137/223
2014/0261871 A1 * 9/2014 Wetsch ..... B31D 5/0073 141/10
2015/0075114 A1 * 3/2015 Murch ..... B29D 22/02 53/52
2015/0239195 A1 * 8/2015 Wetsch ..... B31D 5/0073 53/403
2015/0239592 A1 * 8/2015 Wetsch ..... B65B 51/10 53/79
2015/0283781 A1 * 10/2015 Wetsch ..... B31D 5/0073 53/79
2017/0095991 A1 * 4/2017 Wetsch ..... B31D 5/0043
2017/0275036 A1 * 9/2017 Wetsch ..... B65B 61/06
2017/0282479 A1 * 10/2017 Wetsch ..... B31D 5/0073

* cited by examiner

IDLER ROLLER

CROSS REFERENCE TO RELATED APPLICATION

This application claims priority to U.S. Provisional Patent Application No. 62/314,209, entitled "Idler Roller" and filed on Mar. 28, 2016, which is herein incorporated by reference in its entirety.

TECHNICAL FIELD

The present disclosure relates to packaging materials. More particularly, the present disclosure is directed to devices and methods for manufacturing inflatable cushions to be used as packaging material.

BACKGROUND

A variety of inflated cushions are well known and used for sundry packaging applications. For example, inflated cushions are often used as void-fill packaging in a manner similar to or in place of foam peanuts, crumpled paper, and similar products. Also for example, inflated cushions are often used as protective packaging in place of molded or extruded packaging components. Generally, inflated cushions are formed from films having two plies that are joined together by seals. The seals can be formed simultaneously with inflation, so as to capture air therein, or prior to inflation to define a film configuration having inflatable chambers. The inflatable chambers can be inflated with air or another gas or thereafter sealed to inhibit or prevent release of the air or gas.

Many machines used in the packaging industry operate with numerous rollers some that utilize belts to control the advancement of the film there through. For example, U.S. Pat. No. 8,128,770 discloses a system that utilizes belts and rollers to control the inflation and sealing of cushions. The presence of the belts or other additional components in these machines can make them costly to manufacture and sometimes difficult to use. In another example, U.S. Pat. No. 7,950,433 discloses one roller with a heading element wrapped there around pressed directly against another roller. This sort of system does not allow for adequate cooling of the film before being removed from the machine. As such, an improved inflation and sealing mechanism is desirable in the industry.

SUMMARY

In accordance with various embodiments, and inflation and sealing device that includes an inflation assembly that inflates with a fluid a cushion cavity disposed between overlapping portions of first and second plies of a film, which plies form a flexible structure. The device also includes a sealing mechanism having a first compression element having a curved surface operable to bend the flexible structure thereabout. The sealing mechanism also includes a second compression element positioned against the first compression element to pinch the flexible structure therebetween at a first pinch area. The sealing device also includes a heating element disposed adjacent the first pinch location to heat the film sufficiently to seal the plies to each other to produce a longitudinal seal as the film is moved past the first pinch area. The sealing device also includes a third compression element positioned against the first compression element to pinch the flexible structure therebetween at a second pinch area downstream of the first pinch area. The first, second, and third compression elements hold the flexible structure against the first compression element along a cooling path between the first and second pinch areas. A surface of the film opposite from the first compression element is substantially free of contact with the sealing mechanism. The film is sufficiently retained against the first compression element to hold the fluid in the cushion cavity while the longitudinal seal cools.

In accordance with various embodiments, the first, second, and third compression elements are nip rollers. In one embodiment, the first nip roller has a rotation axis, and the first and second pinch areas are separated by an angle of greater than 30° as measured about the rotation axis. In various embodiments, the first nip roller, the second nip roller and the third nip roller each have approximately a same radius. In another embodiment, the first and second pinch areas are separated by an angle of greater than 60° as measured about the rotation axis. In various embodiments, the first and second pinch areas are separated by an angle of up to 180° as measured about the rotation axis.

In accordance with various embodiments, the first nip roller is movable relative to the second nip roller such that the first and second nip rollers can be separated for loading or removing the film from therebetween. The third nip roller is movable relative to relative to at least one of the second nip roller and the first nip roller such that the third nip roller can be separated from at least one of the second nip roller and the first nip roller for loading or removing the film from therebetween. The third nip roller is positioned on a third nip roller lever having a pivot point positioned at a location different than the axis of rotation of the third nip roller, such that rotation of the lever about the pivot point moves the third nip roller toward or away from the first nip roller. The third nip roller lever is spring loaded such that the third nip roller lever biases the third nip roller toward the first nip roller such that the third nip roller is operable to compress the flexible structure against the first nip roller under the force of the spring. The first nip roller is positioned on a lever having a pivot point positioned at a location different than the axis of rotation of the first nip roller, with the pivot point positioned such that rotation of the lever about the pivot point moves the first nip roller toward or away from the second nip roller. The first nip roller lever is spring loaded such that the first nip roller lever biases the first nip roller toward the second nip roller compressing the flexible structure against the second nip roller under the force of the spring. The pivot point is positioned such that rotation of the lever about the pivot point moves the first nip roller generally tangentially relative to the pinch area with the third nip roller. The first nip roller lever engages the third nip roller lever such that as the first nip roller lever rotates moving the first nip roller away from the second nip roller, the first nip roller lever causes the third nip roller lever to rotate such that the third nip roller moves away from the second pinch area. The third nip roller lever includes a notch having a surface that engages the first nip roller lever such that forces from the first nip roller lever against the notch surface causes the third nip roller lever to rotate. The third nip roller axis is positioned between the notch and the third nip roller lever pivot.

In accordance with various embodiments, the sealing mechanism is beltless. In accordance with various embodiments, the inflatable-cushion inflation and sealing device also can include a cover that covers one or more of the first, second, or third rollers and provides a slot operable to redirect the flexible structure after the flexible structure exits the second pinch area.

In accordance with various embodiments, and inflation and sealing device that includes an inflation assembly that inflates with a fluid a cushion cavity disposed between overlapping portions of first and second plies of a film, which plies form a flexible structure. The device also includes a sealing mechanism a first compression element having a curved surface operable to bend the flexible structure thereabout. The sealing mechanism also includes a second compression element positioned against the first compression element to pinch the flexible structure therebetween at a first pinch area. The sealing mechanism also includes a third compression element positioned against the first compression element to pinch the flexible structure therebetween at a second pinch area downstream of the first pinch area. The sealing mechanism also includes a heating element disposed adjacent to the first compression element and second compression element. The first compression element is adjustable relative to the second compression element and the third compression element is adjustable relative to the first compression element. The first compression element engages the third compression element such that as the first compression element is adjusted away from the second compression element, the third compression element is automatically moved away from the first compression element.

In accordance with various embodiments, the first, second, and third compression elements are first, second, and third nip roller assemblies having first, second, and third nip rollers, respectively. The third nip roller is positioned on a third nip roller lever having a pivot point positioned at a location different than the axis of rotation of the third nip roller. The pivot point is positioned such that rotation of the lever about the pivot point moves the third nip roller toward or away from the first nip roller. The third nip roller lever is spring loaded such that the third nip roller lever biases the third nip roller toward the first nip roller such that the third nip roller is operable to compress the flexible structure against the first nip roller under the force of the spring. The first nip roller is positioned on a lever having a pivot point positioned at a location different than the axis of rotation of the first nip roller. The pivot point positioned such that rotation of the lever about the pivot point moves the first nip roller toward or away from the second nip roller. The first nip roller lever is spring loaded such that the first nip roller lever biases the third nip roller toward the second nip roller such that the first nip roller is operable to compress the flexible structure against the second nip roller under the force of the spring. The pivot point is positioned such that rotation of the lever about the pivot point moves the first nip roller generally tangential to the pinch area with the third nip roller. The third nip roller lever includes a notch having a surface that engages the first nip roller lever such that forces from the first nip roller lever against the notch surface causes the third nip roller lever to rotate and the third nip roller axis is positioned between the notch and the third nip roller lever pivot.

In accordance with various embodiments, the first, second, and third nip rollers hold the flexible structure against the first nip roller along a cooling path between the first and second pinch areas with a surface of the film opposite from the first compression element substantially free of contact with the sealing mechanism. The film is sufficiently retained against the first compression element to hold the fluid in the cushion cavity while the longitudinal seal cools. In accordance with various embodiments, the sealing mechanism is beltless.

DETAILED DESCRIPTION

The present disclosure is related to protective packaging and systems and methods for converting uninflated material into inflated cushions that may be used as cushioning or protection for packaging and shipping goods.

Figure 1:
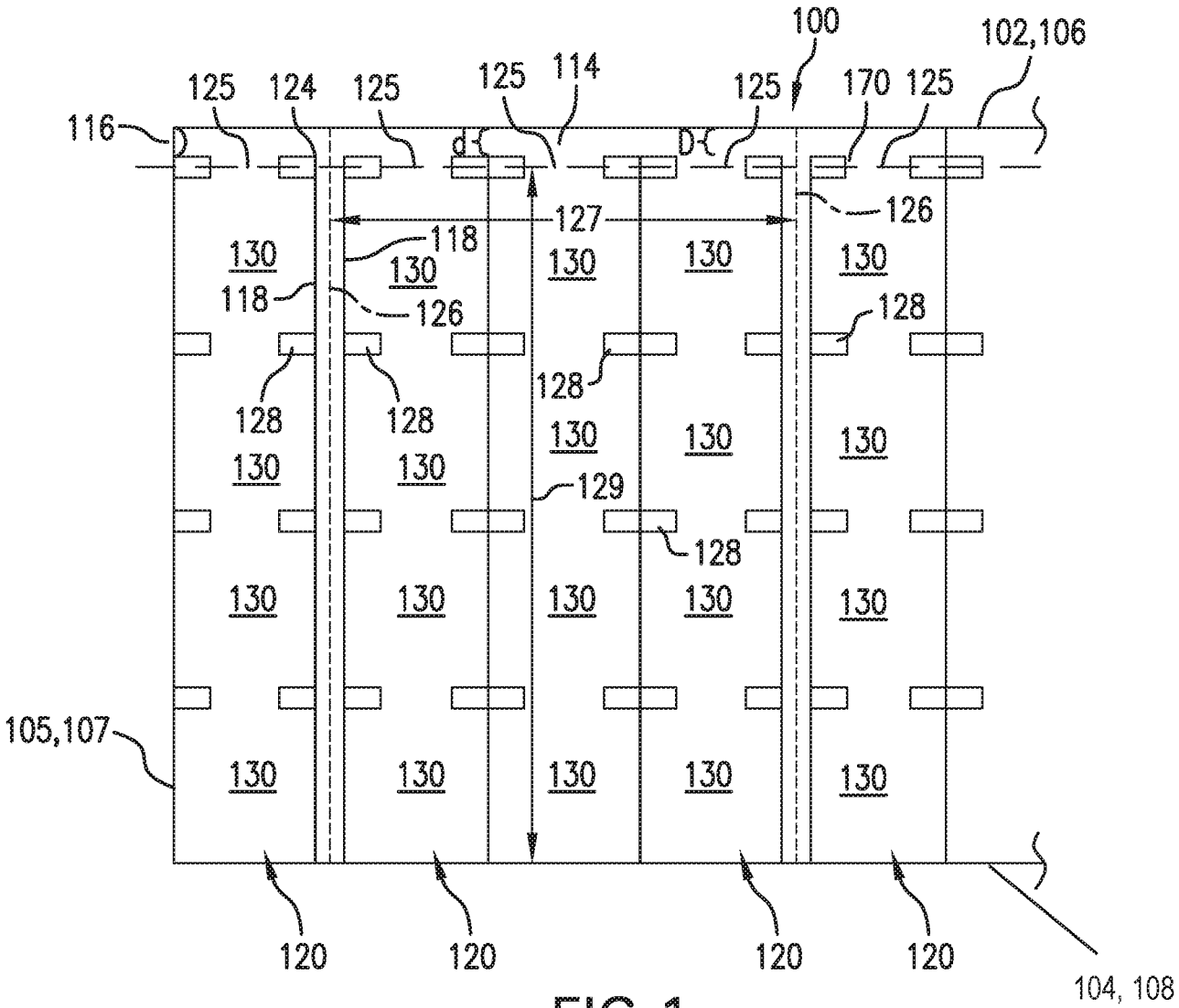
FIG. 1 is a top view of an uninflated material flexible structure according to an embodiment.

As shown in FIG. 1, a multi-ply flexible structure 100 for inflatable cushions is provided. The flexible structure 100 includes a first film ply 105 having a first longitudinal edge 102 and a second longitudinal edge 104, and a second film ply 107 having a first longitudinal edge 106 and a second longitudinal edge 108. The second ply 107 is aligned to be overlapping and can be generally coextensive with the first ply 105, i.e., at least respective first longitudinal edges 102, 106 are aligned with each other and/or second longitudinal edges 104, 108 are aligned with each other. In some embodiments, the plies can be partially overlapping with inflatable areas in the region of overlap.

FIG. 1 illustrates a top view of the flexible structure 100 having first and second plies 105, 107 joined to define a first longitudinal edge 110 and a second longitudinal edge 112 of the film 100. The first and second plies 105, 107 can be formed from a single sheet of flexible structure 100 material, a flattened tube of flexible structure 100 with one edge having a slit or being open, or two sheets of flexible structure 100. For example, the first and second plies 105, 107 can include a single sheet of flexible structure 100 that is folded to define the joined second edges 104, 108 (e.g., "c-fold film"). Alternatively, for example, the first and second plies 105, 107 can include a tube of flexible structure (e.g., a flattened tube) that is slit along the aligned first longitudinal edges 102, 106. Also, for example, the first and second plies 105, 107 can include two independent sheets of flexible structure joined, sealed, or otherwise attached together along the aligned second edges 104, 108.

The flexible structure 100 can be formed from any of a variety of web materials known to those of ordinary skill in the art and as such the flexible structure 100 may also be referred to as a web or web 100 herein. Such web materials include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof. Other materials and constructions can be used. The disclosed flexible structure 100 can be rolled on a hollow tube, a solid core, or folded in a fan-folded box, or in another desired form for storage and shipment.

As shown in FIG. 1, the flexible structure 100 can include a series of transverse seals 118 disposed along the longitudinal extent of the flexible structure 100. Each transverse seal 118 extends from the longitudinal edge 112 towards the inflation channel 114, and, in the embodiment shown, toward the first longitudinal edge 110. Each transverse seal 118 has a first end 122 proximate the second longitudinal edge 112 and a second end 124 spaced a transverse dimension d from the first longitudinal edge 110 of the flexible structure 100. A chamber 120 is defined within a boundary formed by the longitudinal seal 112 and pair of adjacent transverse seals 118.

Each transverse seal 118 embodied in FIG. 1 is substantially straight and extends substantially perpendicular to the second longitudinal edge 112. It is appreciated, however, that other arrangements of the transverse seals 118 are also possible. For example, in some embodiments, the transverse seals 118 have undulating or zigzag patterns.

The transverse seals 118 as well as the sealed longitudinal edges 110, 112 can be formed from any of a variety of techniques known to those of ordinary skill in the art. Such techniques include, but are not limited to, adhesion, friction, welding, fusion, heat sealing, laser sealing, and ultrasonic welding.

An inflation region, such as a closed passageway, which can be a longitudinal inflation channel 114, can be provided. The longitudinal inflation channel 114, as shown in FIG. 1, is disposed between the second end 124 of the transverse seals 118 and the first longitudinal edge 110 of the film. Preferably, the longitudinal inflation channel 114 extends longitudinally along the longitudinal side 110 and an inflation opening 116 is disposed on at least one end of the longitudinal inflation channel 114. The longitudinal inflation channel 114 has a transverse width D. In the preferred embodiment, the transverse width D is substantially the same distance as the transverse dimension d between the longitudinal edge 101 and second ends 124. It is appreciated, however, that in other configurations, other suitable transverse width D sizes can be used.

The second longitudinal edge 112 and transverse seals 118 cooperatively define boundaries of inflatable chambers 120. As shown in FIG. 1, each inflatable chamber 120 is in fluid communication with the longitudinal inflation channel 114 via a mouth 125 opening towards the longitudinal inflation channel 114, thus permitting inflation of the inflatable chambers 120 as further described herein.

In various embodiments, the transverse seals 118 have one or more notches 128 that extend toward the inflatable chambers 120. As shown in FIG. 1, opposing notches 128 are aligned longitudinally along adjacent pairs of transverse seals 118 to define a plurality of chamber portions 130 within the inflatable chambers 120. The notches 118 create bendable lines that increase the flexibility of flexible structure 100 that can be easily bent or folded. Such flexibility allows for the film 100 to wrap around regular and irregular shaped objects. The chamber portions 130 are in fluid communication with adjacent chamber portions 130 as well as with the inflation channel 114.

A series of lines of weaknesses 126 is disposed along the longitudinal extent of the film and extends transversely across the first and second plies of the film 100. Each transverse line of weakness 126 extends from the second longitudinal edge 112 and towards the first longitudinal edge 110. Each transverse line of weakness 126 in the flexible structure 100 is disposed between a pair of adjacent chambers 120. Preferably, each line of weakness 126 is disposed between two adjacent transverse seals 118 and between two adjacent chambers 120, as depicted in FIG. 1. The transverse lines of weakness 126 facilitate separation of adjacent inflatable cushions 120.

The transverse lines of weakness 126 can include a variety of lines of weakness known by those of ordinary skill in the art. For example, in some embodiments, the transverse lines of weakness 126 include rows of perforations, in which a row of perforations includes alternating lands and slits spaced along the transverse extent of the row. The lands and slits can occur at regular or irregular intervals along the transverse extent of the row. Alternatively, for example, in some embodiments, the transverse lines of weakness 126 include score lines or the like formed in the flexible structure.

The transverse lines of weakness 126 can be formed from a variety of techniques known to those of ordinary skill in the art. Such techniques include, but are not limited to, cutting (e.g., techniques that use a cutting or toothed element, such as a bar, blade, block, roller, wheel, or the like) and/or scoring (e.g., techniques that reduce the strength or thickness of material in the first and second plies, such as electromagnetic (e.g., laser) scoring and mechanical scoring).

Preferably, the transverse width 129 of the inflatable chamber 120 is 3" up to about 40", more preferably about 6" up to about 30" wide, and most preferably about 12". The longitudinal length 127 between weakened areas 126 can be at least about 2" up to about 30", more preferably at least about 5" up to about 20", and most preferably at least about 6" up to about 10". In addition, the inflated heights of each inflated chamber 120 can be at least about 1" up to about 3", and most preferably about 6". It is appreciated that other suitable dimensions can be used.

While described herein with respect to the flexible structure example shown in the claims, it should be appreciated that other inflatable flexible structures can also be used in conjunction with the other embodiments and examples described herein.

Figure 2A:
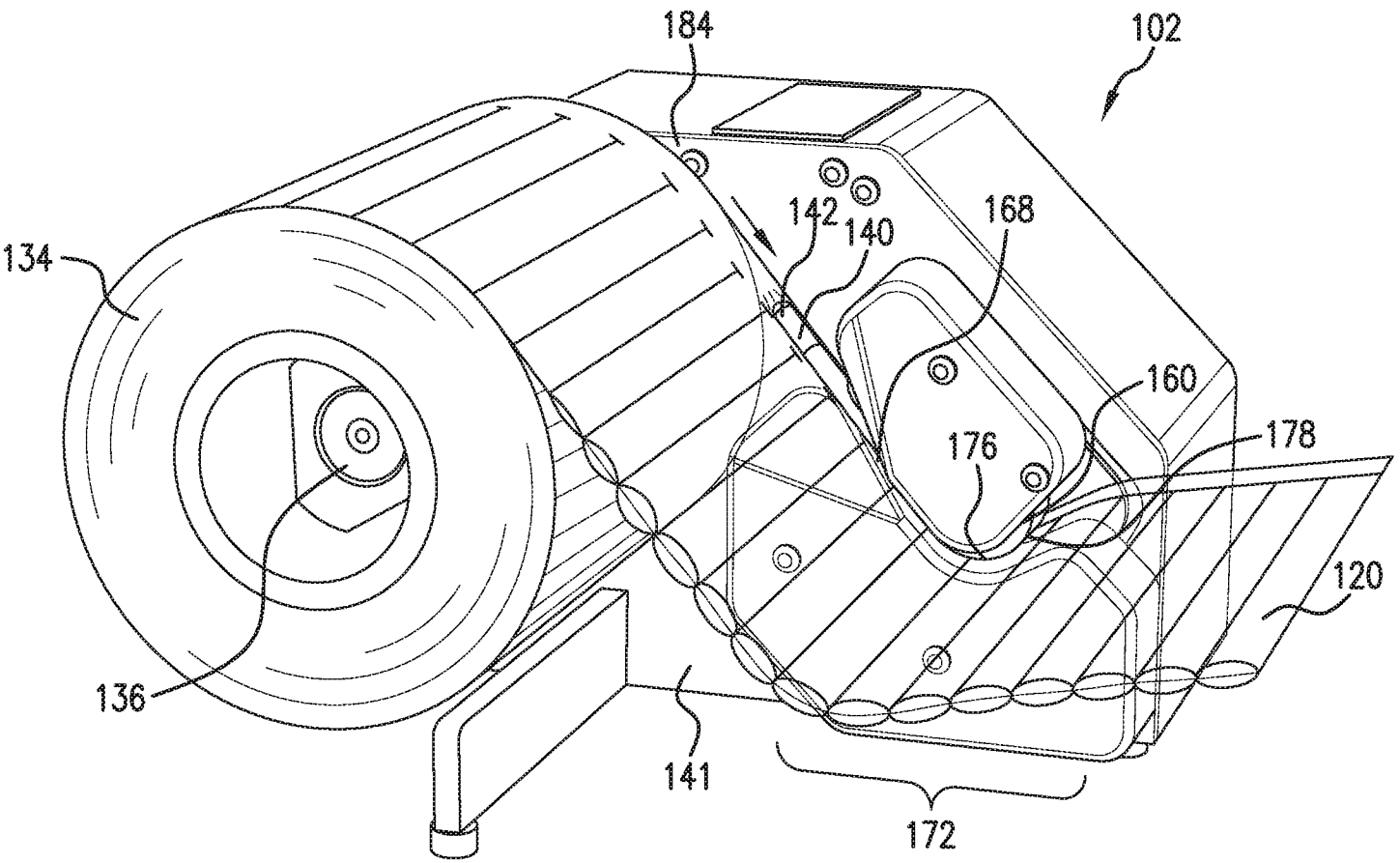
FIGS. 2A-D is a perspective view, front view with covers, front view without covers, and side view, respectively, of the inflation and sealing device in accordance with a first embodiment.
Figure 2B:
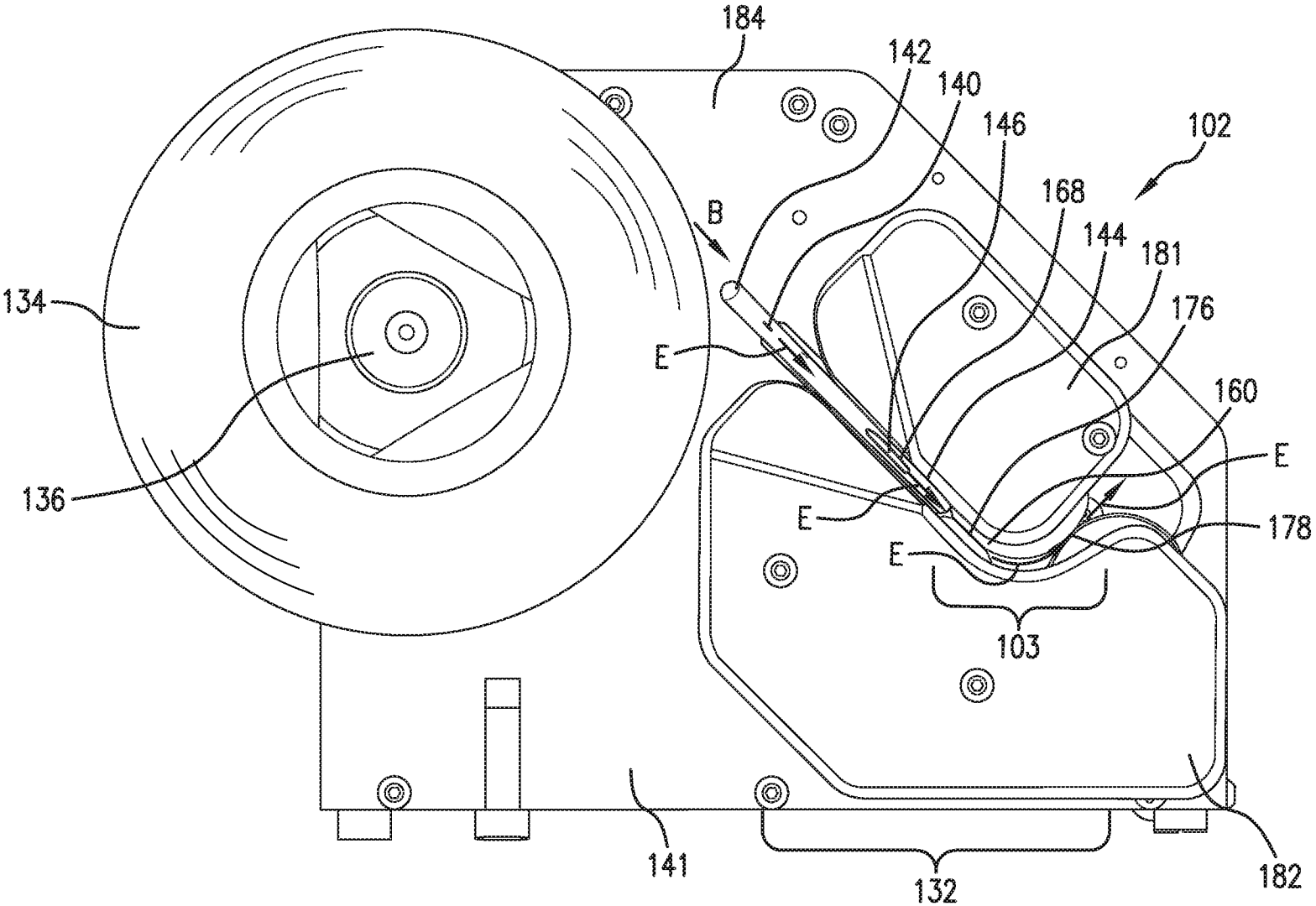
Figure 2C:
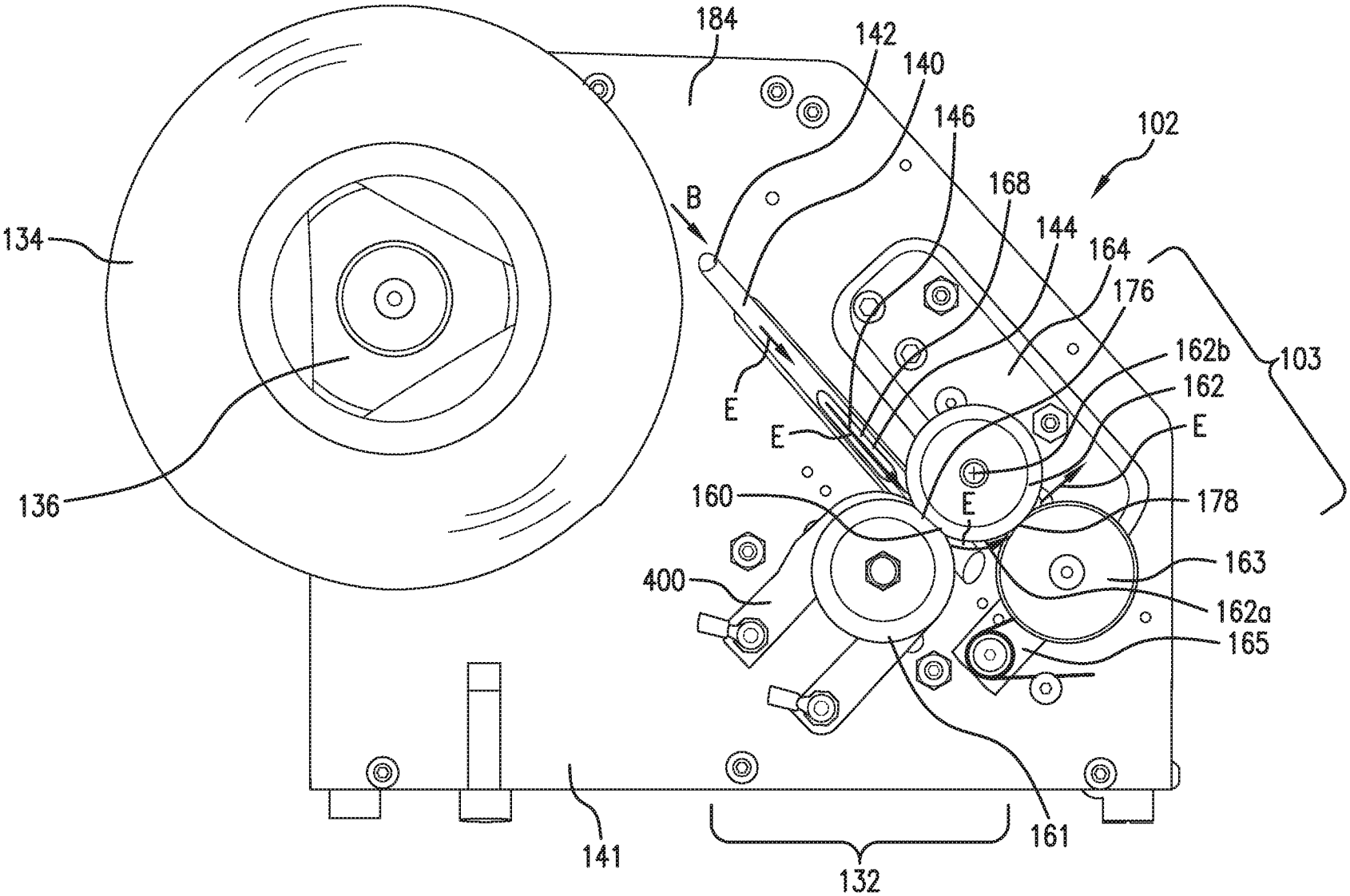

Turning now to FIGS. 2A-3C, an inflation and sealing device 102 for converting the flexible structure 100 of uninflated material into a series of inflated pillows or cushions 120 is provided. As shown in FIG. 2A, the uninflated flexible structure 100 can be a roll of material 134 provided on a roll axle 136. The roll axle 136 accommodates the center of the roll of the material 134. Alternative structures can be used to support the roll, such as a tray, fixed spindle or multiple rollers.

The flexible structure 100 is pulled by a drive mechanism. In some embodiments, intermediate members such as guide rollers can be positioned between roll 134 and the drive mechanism. For example, the optional guide roller can extend generally perpendicularly from a housing 141. The guide roller can be positioned to guide the flexible structure 100 away from the roll of material 134 and along a material path "B" along which the material is processed. In one example, the guide roller may be a dancer roller which may aid in controlling the material 134, such as keeping it from sagging between an inflation nozzle 140 and roll 134.

To prevent or inhibit bunching up of the flexible structure 100 as it is unwound from the roll 134, the roll axle 136 can be provided with a brake to prevent or inhibit free unwinding of the roll 134 and to assure that the roll 134 is unwound at a steady and controlled rate. However, as discussed herein, other structures may be utilized in addition to or as an alternative to use of brakes, guide rollers, or flexible structure feed mechanisms in order to guide the flexible structure 100 toward a pinch area 176 which is part of the sealing mechanism 103. In accordance with various embodiments, as shown in FIGS. 2-4, the flexible structure 100 may be pulled from roll 134 directly to the nozzle 140. While this arrangement may be preferable for simplicity, other arrangements may also be provided. For example, because the flexible structure 100 may sag, bunch up, drift along the guide roller 138, shift out of alignment with the pinch zone 176, alternate between tense and slack, or become subject to other variations in delivery, the inflation and sealing assembly 132 may need suitable adjustability to compensate for these variations. For example, a nozzle 140 may be at least partially flexible, allowing the nozzle 140 to adapt to the direction the flexible structure 100 approaches as the structure is fed towards and over the nozzle 140, thereby making the nozzle 140 operable to compensate for or adapt to variations in the feed angle, direction, and other variations that the flexible structure 100 encounters as it is fed towards and over the nozzle 140.

The inflation and sealing device 102 includes an inflation and sealing assembly 132. Preferably, the inflation and sealing assembly 132 is configured for continuous inflation of the flexible structure 100 as it is unraveled from the roll 134. The roll 134, preferably, comprises a plurality of chambers 120 that are arranged in series. To begin manufacturing the inflated pillows from the flexible structure 100, the inflation opening 116 of the flexible structure 100 is inserted around an inflation assembly, such as an inflation nozzle 140, and is advanced along the material path "E". In the embodiment shown in FIGS. 2A-3C, preferably, the flexible structure 100 is advanced over the inflation nozzle 140 with the chambers 120 extending transversely with respect to the inflation nozzle 140 and side outlets 146. The side outlets 146 may direct fluid in a transverse direction with respect to a nozzle base 144 into the chambers 120 to inflate the chambers 120 as the flexible structure 100 is advanced along the material path "E" in a longitudinal direction. The inflated flexible structure 100 is then sealed by the sealing assembly 103 in the sealing area 174 to form a chain of inflated pillows or cushions.

The side inflation area 168 is shown as the portion of the inflation and sealing assembly along the path "E" adjacent the side outlets 146 in which air from the side outlets 146 can inflate the chambers 120. In some embodiments, the inflation area 168 is the area disposed between the inflation tip 142 and pinch area 176. The flexible structure 100 is inserted around the inflation nozzle 140 at the nozzle tip 142, which is disposed at the forward most end of the inflation nozzle 140. The inflation nozzle 140 inserts a fluid, such as pressured air, into the uninflated flexible structure 100 material through nozzle outlets, inflating the material into inflated pillows or cushions 120. The inflation nozzle 140 can include a nozzle inflation channel 143 there through, as shown for example in FIGS. 6A and 6D, that fluidly connects a fluid source, which enters at a fluid inlet 143*a*, with one or more nozzle outlets (e.g. side outlet 146). It is appreciated that in other configurations, the fluid can be other suitable pressured gas, foam, or liquid. The nozzle may have an elongated portion, which may include one or more of a nozzle base 144, a flexible portion 142*a*, and a tip 142. The elongated portion may guide the flexible structure to a pinch area 176. At the same time, the nozzle may inflate the flexible structure through one or more outlets. The one or more outlets may pass from the inflation channel 143 out of one or more of the nozzle base 144 (e.g. outlet 146), the flexible portion 142*a*, or the tip 142.

Figure 4A:
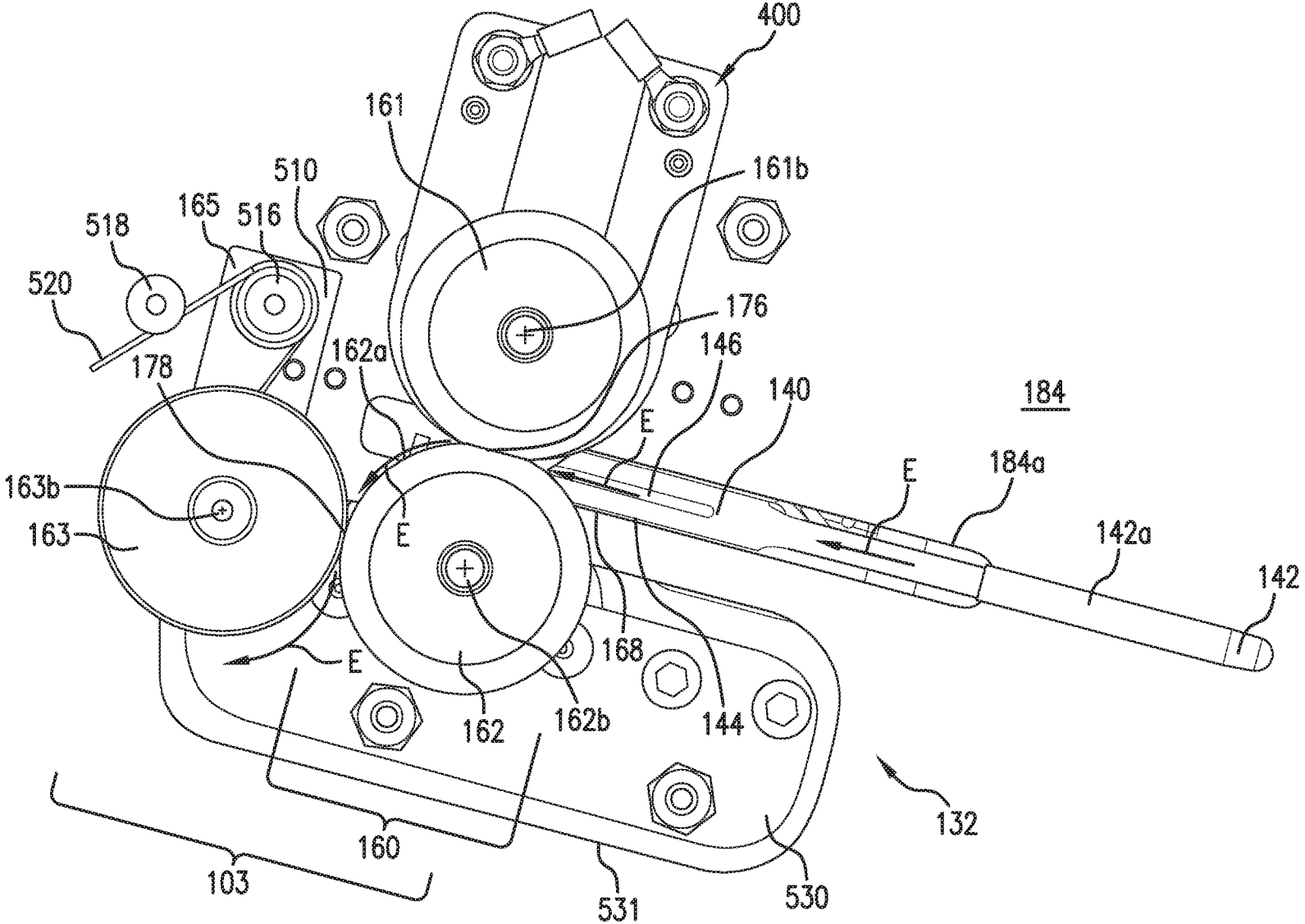
FIG. 4A is a detailed front view without covers of the inflation and sealing assembly in accordance with various embodiments.
Figure 4B:
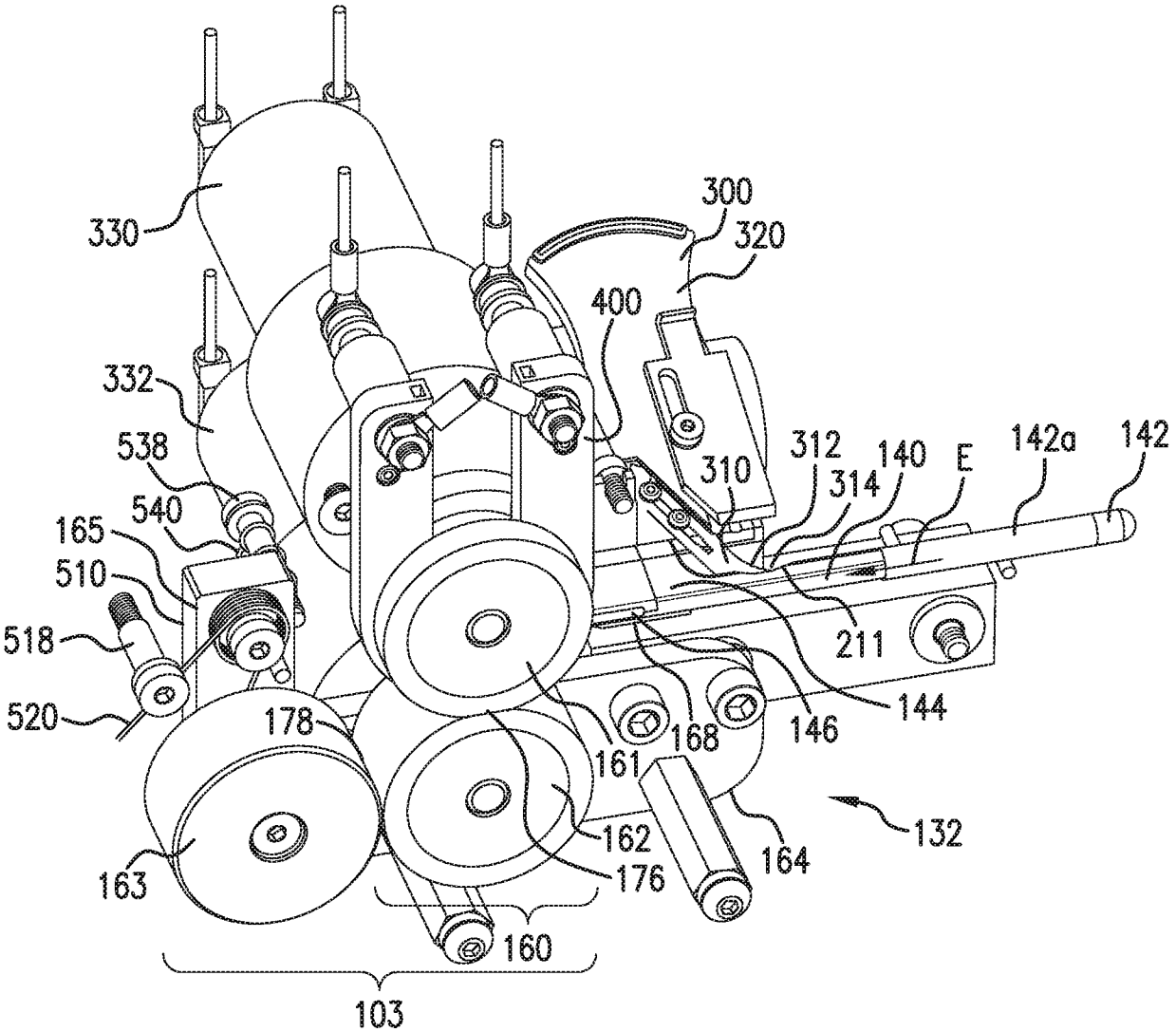
FIG. 4B is a front perspective view without covers of the inflation and sealing assembly in accordance with various embodiments.

As shown in FIG. 4A-B, the side outlet 146 can extend longitudinally along the nozzle base 144 toward a longitudinal distance from the inflation tip 142. In various embodiments, the side outlet 146 originates proximate, or in some configurations, overlapping, the sealer assembly such that the side outlet 146 continues to inflate the inflatable chambers 120 about right up to the time of sealing. This can maximize the amount of fluid inserted into the inflatable chambers 120 before sealing, and minimizes the amount of dead chambers, i.e., chambers that do not have sufficient amounts of air. Although, in other embodiments, the slot outlet 146 can extend downstream past the entry pinch area 176 and portions of the fluid exerted out of the outlet 146 are directed into the flexible structure 100. As used herein, the terms upstream and downstream are used relative to the direction of travel of the flexible structure 100. The beginning point of the flexible structure is upstream and it flows downstream as it is inflated, sealed, cooled and removed from the inflation and sealing device.

The length of the side outlet 146 may be a slot having a length that extends over a portion of the length of the inflation nozzle 140 between the tip 142 and the entry pinch area 176. In one example, the slot length may be less than half the distance from the tip 142 to the entry pinch area 176. In another example, the slot length may be greater than half the distance from the tip 142 to the pinch area 176. In another example, the slot length may be about half of the distance from the tip 142 to the pinch area 176. The side outlet 146 can have a length that is at least about 30% of the length of the inflation nozzle 140, for example, and in some embodiments at least about 50% of the length of the inflation nozzle 140, or about 80% of the length 169 of the inflation nozzle 140, although other relative sizes can be used. The side outlet 146 expels fluid out the lateral side of the nozzle base 144 in a transverse direction with respect to the inflation nozzle 140 through the mouth 125 of each of the chambers 120 to inflate the chambers 120 and chamber portions 130.

The flow rate of the fluid through the nozzle 140 is typically about 2 to 15 cfm, with an exemplary embodiment of about 3 to 5 cfm. The exemplary embodiment is with a blower rated at approximately 14-20 cfm. But much higher blow rates can be used, for example, when a higher flow rate fluid source is used, such as a blower with a flow rate of 1100 cfm.

The nozzle 140 may further include a portion with a fixed longitudinal axis X and a portion with a movable longitudinal axis Y. The nozzle 140 may further include a flexible portion 142*a* which allows the nozzle 140 to be adjustable relative to the travel path "E" of the flexible structure 100. As the flexible structure 100 approaches and the inflation opening 116 engages the tip 142, the flexible core 147 may deflect and adapt to the orientation of the inflation opening 116 such that the inflation channel 114 slides more easily over the nozzle 140. Similarly, if during operation the flexible structure 100 drifts out of alignment, the flexible core 147 may deflect and adapt to the orientation of the inflation channel 114. The nozzle 140 and inflation assembly may be configured in accordance with other embodiments.

The tip of the inflation nozzle can be used to pry open and separate the plies in an inflation channel at the tip as the material is forced over the tip. For example, when the flexible structure is pulled over traditional inflation nozzles, the tips of the traditional inflation nozzles force the plies to separate from each other.

A longitudinal outlet may be provided in addition to or in the absence of the lateral outlet, such as side outlet 146, which may be downstream of the longitudinal outlet and along the longitudinal side of the nozzle wall of the nozzle base 144 of the inflation nozzle 140.

In various embodiments, the inflation nozzle 140 can be positioned horizontally, angled upwards, angled downwards, or in variation in between. In other embodiments, the inflation nozzle 140 may be angled such that it aligns material path "E" of the sealing assembly to approach the nozzle 140 in a direction that accommodates the angle at which the roll 134 dispenses the flexible material 100 and in which the sealing assembly 134 processes the flexible material 100. The inflation nozzle base 144 and its longitudinal axis X may be aligned tangentially to the sealing assembly. The nozzle 140 may be flexible, allowing for variations in the approach of the flexible structure 100.

FIGS. 2A-4B illustrate a side view of the inflation and sealing assembly 132. As shown, the fluid source can be disposed behind a housing plate 184 or other structural support for the nozzle and sealing assemblies, and preferably behind the inflation nozzle 140. The housing plate 184 includes a sealing and inflation assembly opening 184*a* as shown in FIG. 4A. The fluid source is connected to and feeds the fluid inflation nozzle conduit 143. The flexible structure 100 is fed over the inflation nozzle 140, which directs the flexible structure to the inflation and sealing assembly 132.

The flexible structure 100 is advanced or driven through the inflation and sealing assembly 132 by a drive mechanism 160. The drive mechanism 160 includes one or more devices operable to drive the flexible structure through the system. For example, the drive mechanism includes one or more motor-driven rollers operable to drive the flexible material 100 in a downstream direction along a material path "E". One or more of the rollers or drums are connected to the drive motor such that the one or more rollers drive the system. In accordance with various embodiments, the drive mechanism 160 drives the flexible structure 100 without a belt contacting the flexible structure. In one example, the entire system is beltless. In another example, the system has a belt on drive elements that do not come into contact with the flexible structure 100. In another example, the system has a belt on some drive elements but not others.

In accordance with various embodiments, the sealing assembly 132 includes the drive mechanism 160. The drive mechanism 160 includes at least one compression element 162. The at least one compression element 162 may include a curved surface 162*a* that is operable to bend the flexible structure about a bend axis 162*b*. The drive mechanism 160 includes another compression element 161 that is positioned adjacent to the compression element 162. The compression element 161 is positioned relative to the compression element 162 such that the two compression elements 161, 162 together are operable to receiving the flexible material 100 at a pinch area 176. The pinch area 176 is defined by the area in which the compression element 161 and the compression element 162 are positioned against the flexible structure 100 to pinch the flexible structure 100 there between.

The drive mechanism 160 can also include another compression element 163. The compression element 163 is also positioned adjacent to the compression element 162. The relationship between the compression element 163 and the compression element 162 is such that the two compression elements 162, 163 form a second pinch 178 area in which the compression element 163 and the compression element 162 contact the contact and apply pressure to the flexible material 100.

In accordance with various embodiments, the drive system forms a cooling path that is disposed downstream of the first pinch 160. In one example, the cooling path is defined by the curved surface 162*a*. The peripheral area of the curved surface 162*a* along the compression element 162 forms a contact area that engages the flexible material directly. As discussed in more detail below, in some embodiments, the peripheral area is cylindrical and, accordingly, the peripheral area is the outer circumferential area of the cylinder. In other embodiments, the peripheral area is the outer area of the surface of the shape defining the compression element 162. In accordance with the various embodiments, the compression element 162 forms a path between pinch area 176 and pinch area 178 that allows the newly formed longitudinal seal 112 on the flexible material 100. The longitudinal seal 112 is formed by a heating assembly 400 that is a part of sealing assembly 132. The pinch area 178 holds the flexible structure sufficiently tight against the curved surface 162*a* of the compression element 162 to retain the fluid within the chamber 120 as the longitudinal seal 112 cools. Holding the longitudinal seal 112 against the cooling zone limits the stretching and deformation caused by the air pressure within the inflated chamber at the longitudinal seal 112. Absent the holding pressure caused by the pinch area 176 and 178 against the cooling zone along curved surface 162*a*, the effectiveness of the longitudinal seal 112 would be reduced due to the air pressure within the inflated chamber. In accordance with various embodiments, the cooling zone is sufficiently long to allow sufficient cooling of the longitudinal seal 112 to set in the seal such that the air pressure within the inflated chamber 120 does not stretch or deform the longitudinal seal 112 beyond the longitudinal seal 112's ability to hold the air pressure therein. If the cooling zone is not sufficiently long, the longitudinal seal does not properly set. If the angle between the pinch area 176 and the pinch area 178 is too far the inflated material will wrap back on itself. Thus the location of the compression element 163 and the compression element 161 relative to one another as measured around the curved surface 162*a* should be a position that produces a seal sufficient to hold the chamber pressure without allowing the flexible material to interfere with itself.

In accordance with various embodiments, the surface of the film that is not in contact with the curved surface 162*a* is free of contact with other drive components of the inflation and sealing device in the cooling zone. Such a configuration allows heat to escape from this side of the material. For example, the free surface is free of contact with rollers, belts, heating elements, or the like. In some of these particular embodiments having a free surface, some incidental contact may be made between the free surface and a guide element such as a cover, however a snug interface between the film and the surface 162*a* through the cooling zone can minimize this.

In accordance with various embodiments, the pinch area 178 is located at an angle that is greater than 15° from the pinch area 176 as measured around axis 162*a*. In such an embodiment, the curvatures of the compression elements 161 and 163 are smaller than the radius of the curved area 162*a* of compression element 162. In various embodiments, the pinch area 178 is located at an angle that is at least or greater than 60° from the pinch area 176 as measured around axis 162*a*. In such an embodiment, the radius of the curvature of the compression elements 161 and 163 can be approximately the same radius as the curved area 162*a* of compression element 162. In other examples of this embodiment, the radius of the curvature of the compression elements 161 and 163 can be greater than the radius of the curved area 162*a* of compression element 162. In accordance with various embodiments, the pinch area 178 is located between 30° and 180° from the pinch area 176 as measured around axis 162*a*. In such embodiments, the curved surface 162*a* is cylindrical between the pinch area 176 and 178 with a radius of between about 1 and ½ cm and 3 cm. In a particular example, the pinch area 178 is located about 90° from the pinch area 176 as measured around axis 162*a*. In this example, the radius of curved surface 162*a* or the cooling zone is about 3¼ cm. The outer surface of the compression element 162 is preferable smooth and continuous. In other embodiments, however, the outer surface may be conical, concave, or have a contoured surface.

In each of the above embodiments and examples, it should be appreciated that the pinch areas 176 and 178 are defined by the positions of the compression elements 161, 162 and 163 relative to each other. As such, the positions between compression elements 161 and 163 can be similarly defined by the angles there between such that those positions create the relative locations of the pinch points discussed above.

In accordance with various embodiments, one or both of the compression elements 161 and 163 also have curved surfaces. In accordance with one example, all three compression elements 161, 162, and 163 are cylindrical. In a more particular example, one or more of the compression elements 161, 162, and 163 are rollers. These rollers can be nip rollers that pinch the flexible material 100. As such, in accordance with various examples, the compression element 161 can be a roller that forms the first pinch area 176 with the compression element 162 that is also a roller having an axis of rotation about the axis 162*b*. Similarly, in the same example, the compression element 163 can be a roller that forms the second pinch area 178 with the compression element 162 that is also a roller having an axis of rotation about the axis 162*b*. Under this example, the nip rollers 161 and 162 can pinch the flexible material 100 at pinch area 176 and drive the material to the pinch area 178 between nip rollers 163 and 162 while maintaining direct contact between the flexible material 100 and the outer circumference 162*a* of the nip roller 162.

In accordance with various embodiments, each of the compression elements may be variously adjustable relative to the other compression elements. Thus, the compression element 161 can be adjustable relative to at least one of compression elements 162 or 163. The compression element 162 can be adjustable relative to at least one of compression elements 161 or 163. The compression element 163 can be adjustable relative to at least one of compression elements 161 or 162. In a preferred embodiment, compression element 162 is stationary with one or more of compression elements 161 and 163 adjustable relative to the compression element 162. For example, the compression element 161 is adjustable relative to the compression element 162. In another example, the compression element 163 is adjustable relative to the compression element 162. In a third example, both the compression elements 161 and 163 are adjustable relative to compression element 162. The adjustment of the various compression elements relative to one another is such that the adjustment forms a gap between each of the compression elements in an open state and removes the gap or forms a sufficiently small gap in a closed state so that the various compression elements pinch the flexible material 100 there between.

In accordance with various embodiments, one or more of the various compression elements 161, 162, and 163 can include an adjustment mechanism that allows the adjustment discussed above between the various compression elements 161, 162, and 163. The adjustment of the various compression elements 161, 162, and 163 relative to one another may be accomplished manually, mechanically, or a combination of the two. This adjustment can be rectilinear, curvilinear, or include any combinations of paths that allow controlled movement between the various compression elements.

Figure 4C:
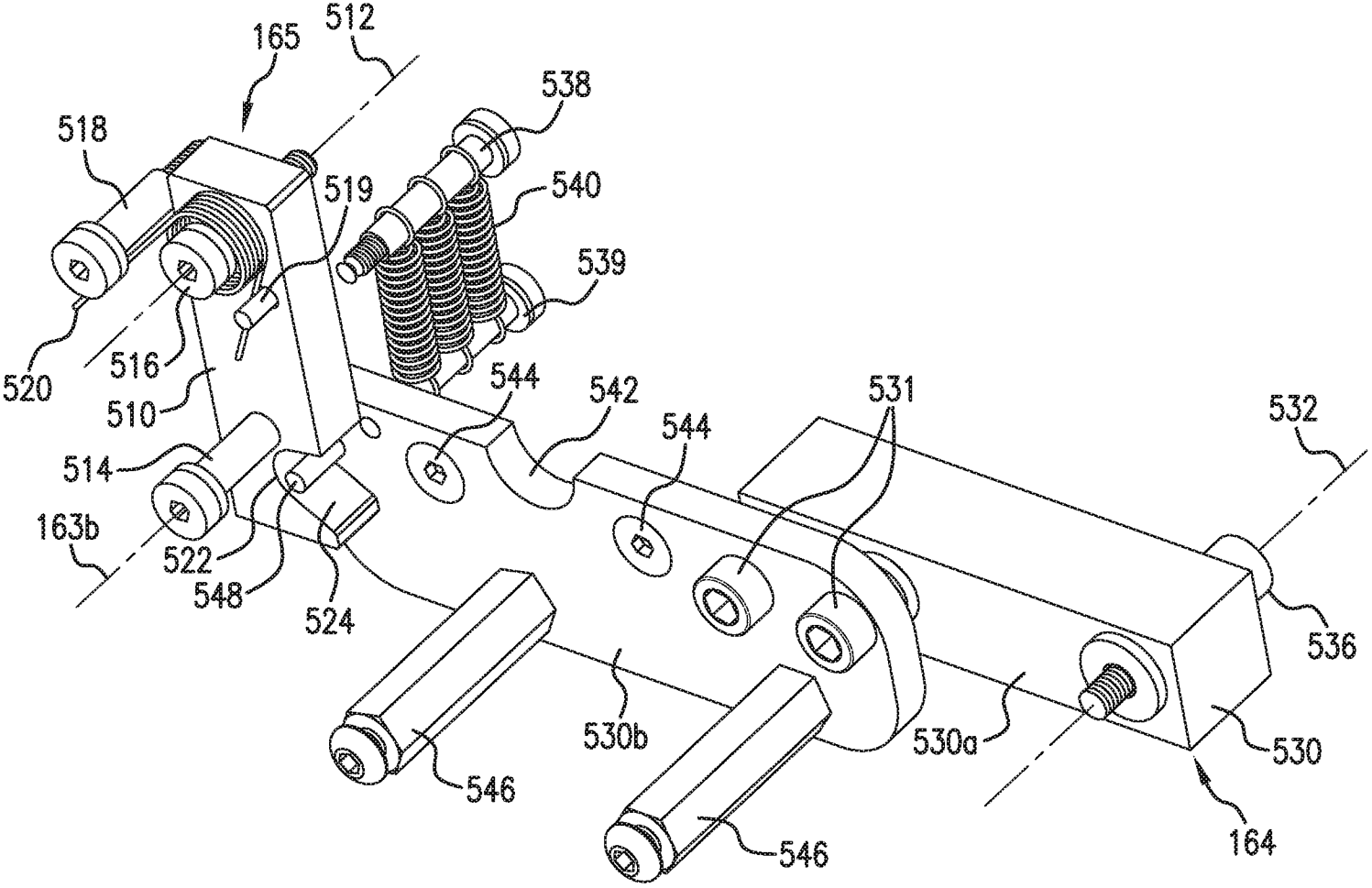
FIG. 4C is a front perspective view of the compression mechanism in accordance with various embodiments.

In various examples and as illustrated in FIGS. 4A-C, the compression element 163 is positioned on an adjustment mechanism 165. The adjustment mechanism 165 is a device that is operable to move the compression element 163 toward or away from another compression element such as compression element 162. This adjustment creates or decreases the gap discussed above so that the flexible material 100 can be fit into the gap and then pinched between compression elements 163 and 162. In various examples, the adjustment mechanism 165 includes a lever 510. The lever 510 is pivotable about an axis 512. For example, the lever 510 includes a hole that mounts on a stud 516, with the stud 516 and the lever hole being coaxial at axis 512. The compression element 163 mounts coaxial with a second axis 163*b* positioned at a first distance from axis 512. The second axis 163*b* may be defined by the stud 514 around which the compression element 163 may pivot in embodiments in which the compression element 163 pivots. In accordance with various embodiments, the axis 512 is positioned such that rotation of the lever 510 about the axis 512 moves the compression element 163 generally radial to the compression element 162 at the pinch area 178.

In accordance with various embodiments, the compression element 163 is biased toward the compression element 162. For example, a biasing mechanism 520 biases the adjustment mechanism 165 toward the compression element 162 such that the compression element 163 is biased toward the compression element 162. In one particular example, the biasing mechanism 520 is a torsion spring positioned around stud 516 with a first end of the torsion spring engaging a stud 518 extending from the housing (e.g. the housing plate 184) and the second end of the torsion spring 520 engaging the lever 510. The torsion spring 520 is positioned in such a manner that the torsion spring 520 forces the end of the lever opposite the stud 516 toward the compression element 162. With the compression element 163 positioned on the end of the lever opposite the stud 516, the compression element 163 pivots about the axis 512 at the stud 516 and is forced against the compression element 162. The force exerted by the spring causes the compression element 163 and the compression element 162 to compress the flexible material there between under the force of the spring. While this example and the illustrated example in FIGS. 4A-C are directed to a torsion spring, it may be appreciated that other biasing mechanisms may be used as well including coil springs, extension springs, a flexible lever, counterweights, or any device known or developed in the art.

In various examples and as illustrated in FIGS. 4A-C, the compression element 162 is also or alternatively positioned on an adjustment mechanism such as adjustment mechanism 164. The adjustment mechanism 164 is a device that is operable to move the compression element 162 toward or away from another compression element such as compression element 162. This adjustment creates or decreases the gap discussed above so that the flexible material 100 can be fit into the gap and then pinched between compression elements 162 and 161. In various examples, the adjustment mechanism 164 includes a lever 530. Lever 530 can be made of a single integral structure or multiple connected structures such as those shown in FIGS. 4A-C. The lever 530 is pivotable about an axis 532. For example, the lever 530 includes a hole at a first end that mounts on a stud 536, with the stud 536 and the lever hole being coaxial at axis 532. The compression element 162 mounts coaxial with a second axis 162*b* positioned at a first distance from axis 532. In various embodiments, the compression element 162 does not mount directly to the lever 530 (either section 530*a* or 530*b*) but instead is positioned relative to the lever 530 at clearance 542. In one example, fasteners 544 mount a drive motor 332 (or gearbox, mounting bracket or the like) to the lever 530 and the compression element 162 is mounted to the drive motor 332 along the drive axis 162*b*. In accordance with various embodiments, the axis 532 is positioned such that rotation of the lever 530 about the axis 532 moves the compression element 162 generally tangential to the compression element 163 at the pinch area 178 and generally radially to the compression element 161 at the pinch area 176.

In accordance with various embodiments, the compression element 162 is biased toward the compression element 161. For example, a biasing mechanism 540 biases the adjustment mechanism 164 toward the compression element 161 such that the compression element 162 is biased toward the compression element 161. In one particular example, the biasing mechanism 540 includes one or more extension springs positioned between a stud 539 and a stud 538. The stud 538 is mounted extending from the housing (e.g. the housing plate 184) and the stud 539 is mounted extending from the lever 530. In this way, the extension springs bias the stud 538 toward the stud 539. The extension springs 540 are positioned in such a manner that extension springs 540 forces the end of the lever opposite the stud 536 toward the compression element 161. With the compression element 162 positioned on the end of the lever 530 opposite the stud 536, the compression element 162 pivots about the axis 532 at the stud 536 and is forced against the compression element 161. The force exerted by the biasing member 540 causes the compression element 162 and the compression element 161 to compress the flexible material 100 there between under the force of the biasing member 540. While this example and the illustrated example in FIGS. 4A-C are directed to extension springs, it may be appreciated that other biasing mechanisms may be used as well including coil springs, torsion springs, a flexible lever, counterweights, or any device known or developed in the art suitable to biasing a mechanical system.

In accordance with one embodiment, the lever 530 may include bracket 530*a* and bracket 530*b*. The two brackets are connected to one another such that bracket 530*a* pivots about axis 532 behind plate 184, while bracket 530*b* pivots with at least one surface extending through or approximately flush with the plate 184. For example, plate 184 may have an opening 531 extending there through. Bracket 530*b* may extend partway through this opening 531 or all the way through the opening 531. In a preferred embodiment, the front surface of bracket 530*b* is approximately flush with the front surface of plate 185 such that features extending from the front surface of bracket 530 extend from a surface that is generally in the same plane as features extending from the front surface of plate 185. It may also be appreciated that lever 530 may be made with a single integrally formed lever with different front surfaces to operate in the manner described herein. In other embodiments, lever 530 may operate entirely behind, in front of, or in the absence of plate 185.

In accordance with various embodiments, the adjustment mechanism 164 and the adjustment mechanism 165 may be engaged with each other such that when one adjustment mechanism is moved to create a gap or decrease a gap between compression elements, then the other adjustment mechanism is similarly moved to create a gap or decrease a gap between the compression elements. For example, as shown in FIG. 4C, lever 510 includes a concave notch 522 formed in the end of the lever opposite the pivot axis 512. One side of the notch 522 includes a ramp 524. The notch is sized sufficiently to allow a stud 548 to enter into the concave portion of the notch 522 and engage the ramp 524. In one example, the axis 163*b* is positioned between the notch 522 and the pivot axis 512. In accordance with various embodiments, the stud 548 extends from the lever 530 on an end of the lever opposite the pivot axis 532. As shown in FIG. 4C, as lever 530 is rotated clockwise, the stud 548 engages the ramp 524 creating a force in the lever 510 that would cause the lever to rotate clockwise as well. As the force that causes the lever 530 to rotate clockwise is released, both lever 530 and 510 are biased by their biasing members back to their original biased position. In this manner, when a user rotates lever 530, the pinch areas 176 and 178 between their respective compression elements are released, forming gaps at these pinch areas. The gaps allow the flexible material 100 to be inserted or removed from the drive mechanism 160. It should be appreciated that the engagement between adjustment mechanisms 165 and 164 can be reversed such that adjustment mechanism of mechanism 165 automatically causes adjustment of mechanism 164, just the opposite of what is described above.

In accordance with various embodiments, one or more of the compression elements may be nip rollers as discussed above. Each of the nip rollers may be directly driven by a motor. In one example, nip roller 162 is directly driven by motor 332. In one example, nip roller 161 is directly driven by motor 330. In one example, both nip rollers 161 and 162 are directly driven by motors 330 and 332, respectively. In various embodiments, nip roller may be driven alone, in combination with nip roller 16, in combination with nip roller 162, or in combination with both nip rollers 161 and 162. In other embodiments, one motor may drive one or more of the nip rollers via a transmission such as a timing belt.

In accordance with various embodiments, the inflation and sealing device 102 may include one or more covers (e.g. 181 and 182) over the inflation and sealing assembly 132. The covers (e.g. 181 and 182) can be operable to redirect the flexible structure after the flexible structure exits the second pinch area 178. For example, the covers include a deflection surface 183 that contacts the flexible material 100 as it exits the pinch area 178 and separates the flexible material 100 from the compression elements 162 and 163, redirecting the flexible material 100 in any desired direction. The cover may be a harder material than the rollers and sufficiently smooth and continuous to have relatively little engagement or adhering tendency with the flexible material 100.

Figure 2D:
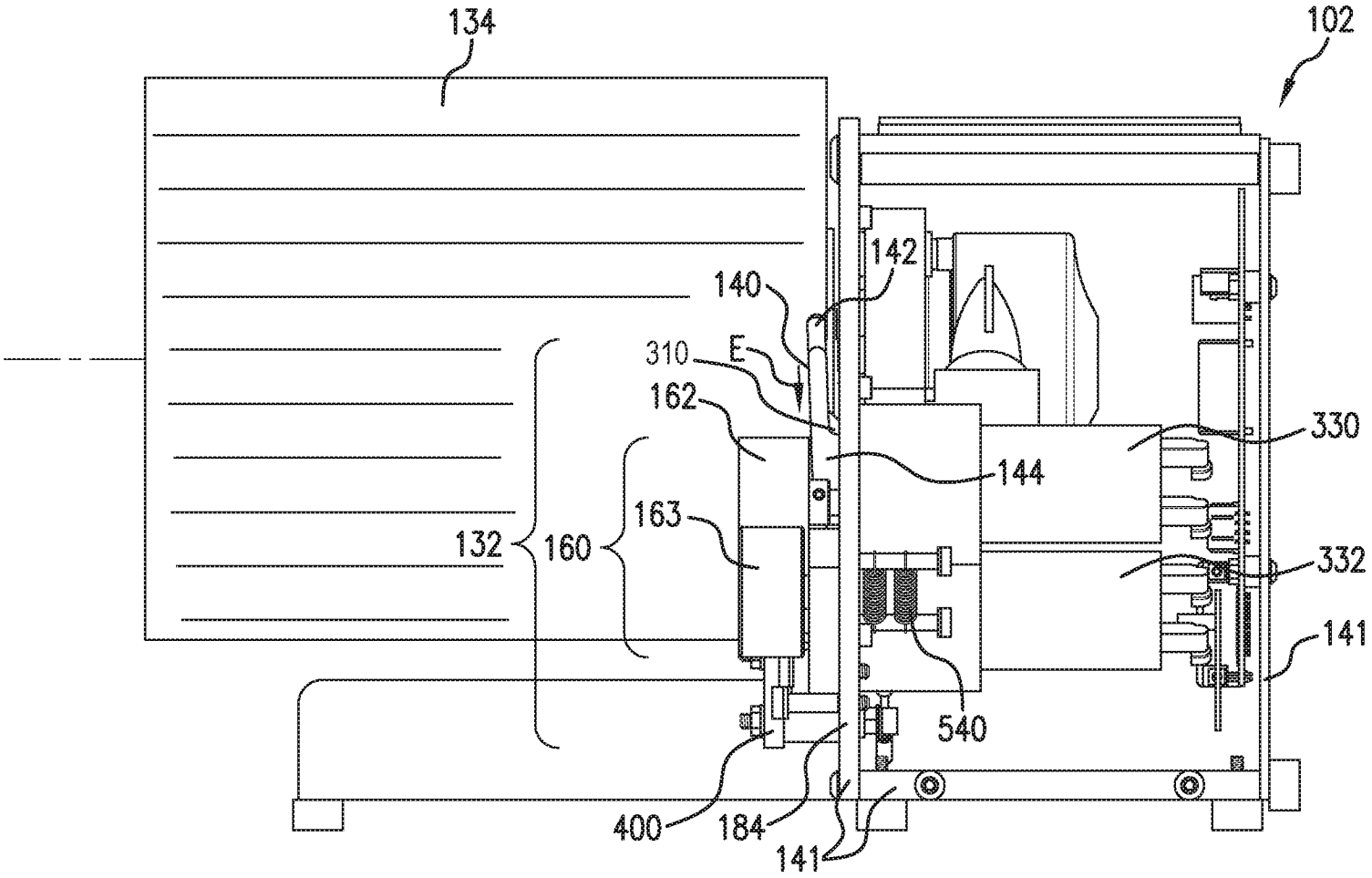

When viewed from the side, such as in FIG. 2D, in a transverse direction extending between separate portions of compression element 161, the heating assembly 400 is positioned transversely between the nozzle 140 and the chambers 120 being inflated to seal across each of the transverse seals. Some embodiments can have a central inflation channel, in which case a second sealing assembly and inflation outlet may be provided on the opposite side of the nozzle. Other known placements of the flexible structure and lateral positioning of the inflation nozzle and sealing assembly can be used.

The heating assembly 400 is positioned adjacent to one or more compression elements 161 and 162, which, as discussed in various embodiments herein, can be driven via a motor or similar motivational source. After inflation, the flexible structure 100 is advanced along the material path "E" towards the pinch area 176 where it enters the sealing assembly 103. The pinch area 176 is disposed between adjacent compression elements 161 and 162. The pinch area 176 is the region in which the first and second plies 105,107 are pressed together or pinched to prevent fluid from escaping the chambers 120 and to facilitate sealing by the heating assembly 400.

The heating assembly 400 may include a heating element 410 disposed adjacent to the pinch location to heat the pinch area 176. In a preferred embodiment, the heating element 410 is located at the pinch area 176. While in the various embodiments disclosed herein the compression elements adjacent to the pinch area 176 may roll, in one embodiment the heating element 410 is a stationary heating element. However, in other embodiments the heating element 410 may move with the compression elements, be stationary with the compression elements, or move relative to the movement of the compression elements. As indicated above, the pinch area 176 is the area wherein the compression elements 161 and 162 are in contact with each other or with the flexible material 100. The compression elements 161 and 162 have sufficient tension to tightly pinch or press the plies 105,107 together. This compression may also bias the plies 105, 107 against the heating assembly 400. During, before, or after being fed through the pinch area 176, the first and second plies 105,107 are sealed together by the heating assembly 400 and exit the pinch area 176. The heating element 410 can be formed of thermocouples, which melt, fuse, join, bind, or unite together the two plies 105,107, or other types of welding or sealing elements. In a preferred embodiment, the heating element 410 is stationary. In other embodiments, the heating assembly may be a roller with the heating element 410 being movable. In other embodiments, the heating assembly may include a heated belt operable to form a seal. For example, the belt could wrap around one or two of the compression elements. The belt could also avoid contact in the cooling zone of the seals.

Preferably, the flexible structure 100 is continuously advanced through the sealing assembly 103 along the material path "E" and past the heating assembly 400 at an area 176 to form a continuous longitudinal seal 170 along the flexible structure 100 by sealing the first and second plies 105, 107 together. The flexible structure 100 exits the pinch area 176, maintaining contact with the compression element 162. The flexible structure 100 continues along the surface of the compression element 162 to a second pinch area 178 that is the area disposed downstream of the first pinch area 176 as shown in FIGS. 2A-D. The sealing area 174 is the area proximal to the first pinch area 176 in which the flexible structure 100 is being sealed by the heating assembly 400. The longitudinal seal 112 is shown as the phantom line in FIG. 1. Preferably, the longitudinal seal 112 is disposed a transverse distance from the first longitudinal edge 102,106, and, most preferably, the longitudinal seal 112 is disposed along the mouths 125 of each of the chambers 120.

In the preferred embodiment, the heating assembly 400 and one or more of the compression elements 161, 162 cooperatively press or pinch the first and second plies 105,107 at the first pinch area 176 against the heating assembly 400 to seal the two plies together. The sealing assembly 103 may rely on pressure from compression element 162 against the heating assembly 400 to sufficiently press or pinch the plies 105,107 there between. In accordance with various embodiments, the compression elements 161, 162, and/or 163 include a flexible resilient material that allows for the pressure between the compression elements and the flexible structure 100 to control the positions of the flexible structure. In various embodiments, the outer surface of the compression elements may be an elastomeric material. For example, the outer surface of the compression elements can be a high temperature shore A 45 durometer silicone rubber with about a ¼" thickness. Other materials or thickness may also be used. For example, one or more of the compression elements may have a low friction outer surface such as polytetrafluoroethylene or similar polymers or low friction materials.

Figure 3A:
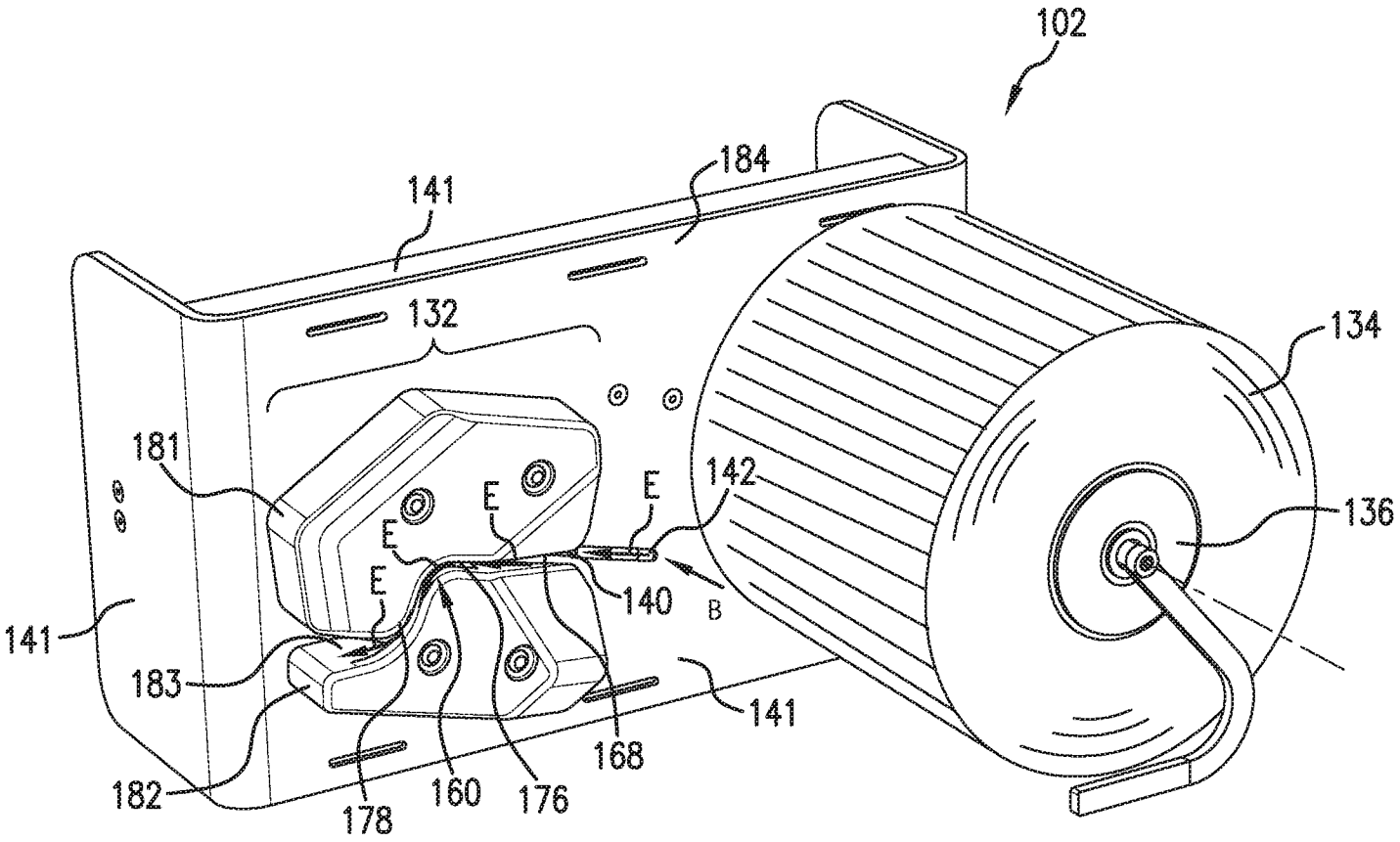
FIGS. 3A-C is a perspective view, front view with covers, and front view without covers, respectively, of the inflation and sealing device in accordance with a second embodiment.
Figure 3B:
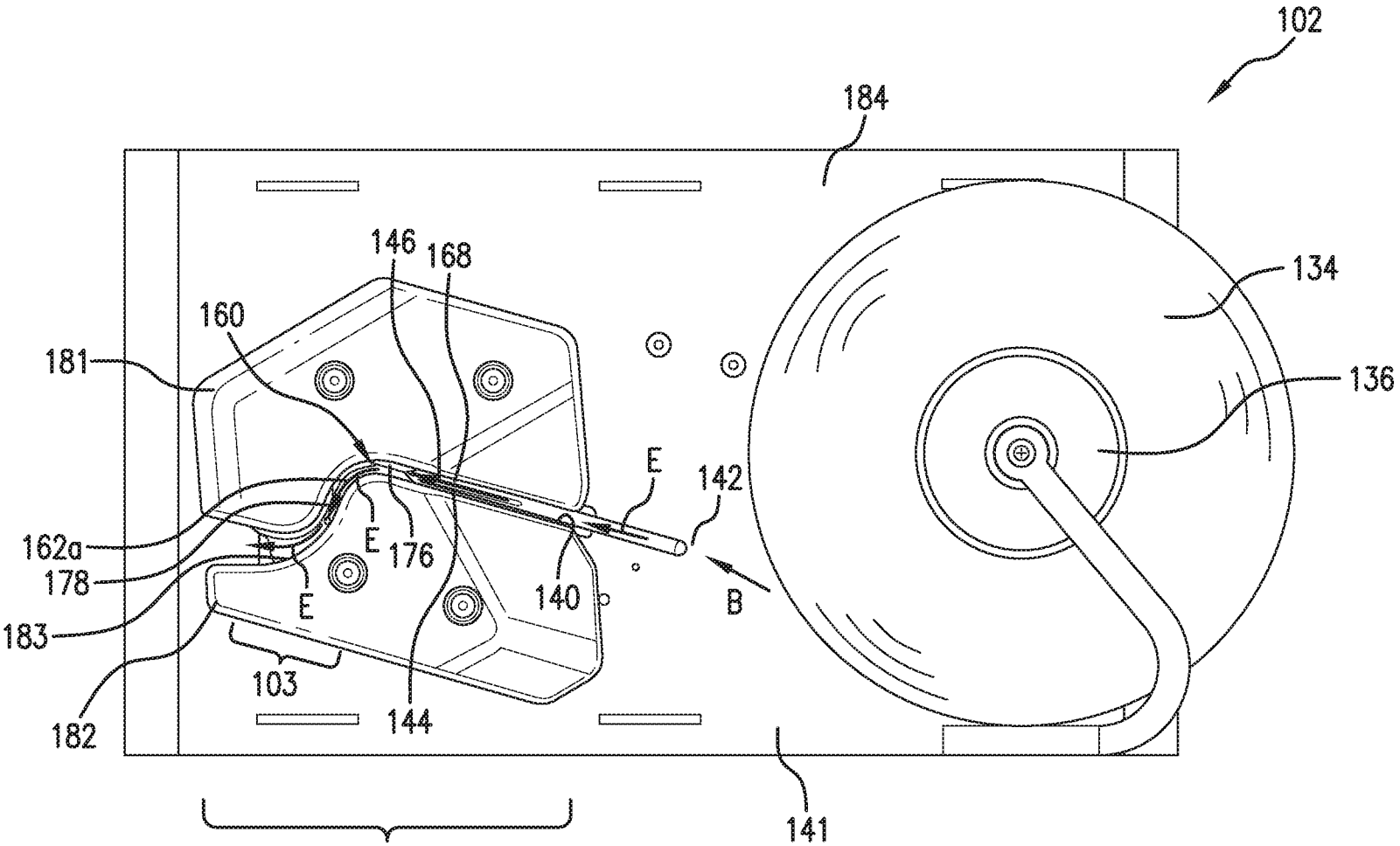
Figure 3C:
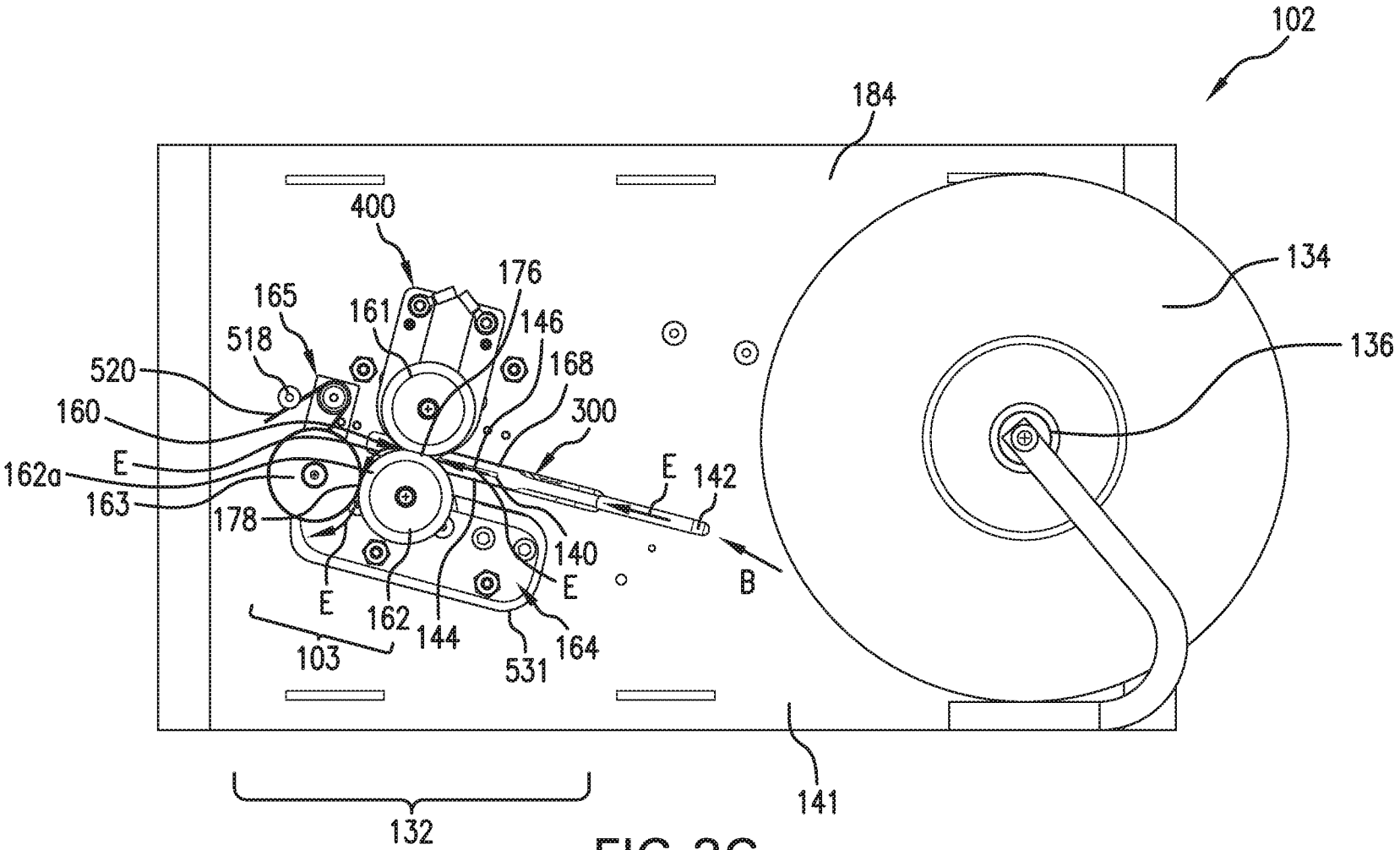

In the embodiment shown in FIGS. 2A-D, the flexible structure 100 enters the sealing assembly 103 at the first pinch area 176 at a downward angle. Although in other embodiments, the flexible structure 100 may enter the sealing assembly 103 at the pinch area 176 that is at an alternate angle relative to the horizontal. For example, FIGS. 3A-C illustrate the path into the pinch area 176 to be much more horizontal. Additionally, the flexible structure 100 exits the sealing assembly 103 at an angle sloped upward with respect to the horizontal so that the flexible structure 100 is exiting facing upwards toward the user. (See FIGS. 2A-D.) Although, horizontal and downward departures are also contemplated herein, such as those shown in FIGS. 3A-C.

In accordance with various embodiments, the inflation and sealing assembly 132 may further include a cutting assembly 300 to cut the flexible structure. The cutting assembly 300 may cut the first and second plies 105,107 between the first longitudinal edge 101 and mouth 125 of the chambers. In some configurations, the cutting assembly 300 may cut the flexible structure 100 to open the inflation channel 114 of the flexible structure 100 and remove the first and second plies 105,107 from the inflation nozzle 140.

As illustrated in FIG. 4B, the cutting assembly 300 can include a cutting device or cutting member, such as a blade 310 with a cutting edge 312, and a cutting tray 320 that holds the blade 310. Preferably, the cutting member is mounted on the tray 320. In other embodiments, it's appreciated that a cutting tray 320 can be omitted, and other suitable mechanisms can be used to position the blade 310 adjacent the inflation nozzle 140. Preferably, the cutting member is sufficient to cut the flexible structure 100 as it is moved past the edge along the material path "E". In the various embodiments, the blade 310 or knife includes a sharp cutting edge 312 and a tip 314 at the distal end of the blade 310. In the embodiment shown, the cutting edge 312 is preferably angled upward toward the inflation nozzle 140, although other configurations of the cutting edge 312 can be used.

As shown in FIG. 4B, the cutting tray 320 holds the blade 310. This may be done magnetically, with a fastener, or by any other method known. In various embodiments, the cutting assembly 300 may be a fixed assembly or a movable one such as those described in U.S. application Ser. No. 13/844,658. The blade 310 may engage slot 211 on the nozzle base 144. This engagement may position the blade 310 relative to the nozzle base 144 such that, as the flexible structure 100 slides over the nozzle base 144, the flexible structure engages the blade 310 and is cut thereby. It may be appreciated that other cutting systems may be utilized with the disclosure provided herein; although the cutting assembly 300 is shown, in other embodiments traditional cutter arrangements can be used, such as a fixed cutter, rotary cutter, or other cutters known in the art.

It is appreciated that the various separate embodiments or combinations of embodiments described herein can also be used on other types of film handling devices and in inflating and sealing devices. An example is disclosed in U.S. Pat. Nos. 8,061,110 and 8,128,770, U.S. Publication No. 2011/0172072, and U.S. application Ser. No. 13/844,658.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

Having described several embodiments herein, it will be recognized by those skilled in the art that various modifications, alternative constructions, and equivalents may be used. The various examples and embodiments may be employed separately or they may be mixed and matched in combination to form any iteration of the alternatives. Additionally, a number of well-known processes and elements have not been described in order to avoid unnecessarily obscuring the focus of the present disclosure. Accordingly, the above description should not be taken as limiting the scope of the invention. Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. An inflatable-cushion inflation and sealing device, comprising:

an inflation assembly that inflates a cushion cavity disposed between overlapping portions of first and second plies of a film with a fluid, wherein the plies cooperatively form a flexible structure;

a sealing mechanism comprising:

a first compression element having a curved surface operable to bend the flexible structure thereabout;

a second compression element positioned against the first compression element to pinch the flexible structure therebetween at a first pinch area;

a heating element disposed adjacent the first pinch location to heat the film sufficiently to seal the plies to each other to produce a longitudinal seal as the film is moved past the first pinch area; and a third compression element positioned against the first compression element to pinch the flexible structure therebetween at a second pinch area downstream of the first pinch area, such that the second, and third compression elements hold the flexible structure against the first compression element along a cooling path between the first and second pinch areas with a surface of the film opposite from the first compression element free of contact with the sealing mechanism while the film is sufficiently retained against the first compression element to hold the fluid in the cushion cavity while the longitudinal seal cools.

2. The inflatable-cushion inflation and sealing device of claim 1, wherein the first, second, and third compression elements are first, second, and third nip rollers, respectively.

3. The inflatable-cushion inflation and sealing device of claim 2, wherein the first nip roller has a rotation axis, and the first and second pinch areas are separated by an angle of greater than 30° as measured about the rotation axis.

4. The inflatable-cushion inflation and sealing device of claim 2, wherein the first nip roller, the second nip roller and the third nip roller each have approximately a same radius.

5. The inflatable-cushion inflation and sealing device of claim 3, wherein the first and second pinch areas are separated by an angle of greater than 60° as measured about the rotation axis.

6. The inflatable-cushion inflation and sealing device of claim 3, wherein the first and second pinch areas are separated by an angle of up to 180° as measured about the rotation axis.

7. The inflatable-cushion inflation and sealing device of claim 2, wherein the first nip roller is movable relative to the second nip roller such that the first and second nip rollers can be separated for loading or removing the film from therebetween.

8. The inflatable-cushion inflation and sealing device of claim 2, wherein the third nip roller is movable relative to at least one of the second nip roller and the first nip roller such that the third nip roller can be separated from at least one of the second nip roller and the first nip roller for loading or removing the film from therebetween.

9. The inflatable-cushion inflation and sealing device of claim 2, wherein the third nip roller is positioned on a third nip roller lever having a pivot point positioned at a location different than an axis of rotation of the third nip roller, such that rotation of the third nip roller lever about the pivot point moves the third nip roller toward or away from the first nip roller.

10. The inflatable-cushion inflation and sealing device of claim 9, wherein the third nip roller lever is spring loaded such that the third nip roller lever biases the third nip roller toward the first nip roller such that the third nip roller is operable to compress the flexible structure against the first nip roller under the force of the spring.

11. The inflatable-cushion inflation and sealing device of claim 10, wherein the first nip roller is positioned on a first nip roller lever having a pivot point positioned at a location different than an axis of rotation of the first nip roller, with the pivot point positioned such that rotation of the first nip roller lever about the pivot point moves the first nip roller toward or away from the second nip roller.

12. The inflatable-cushion inflation and sealing device of claim 11, wherein the first nip roller lever is spring loaded such that the first nip roller lever biases the first nip roller toward the second nip roller compressing the flexible structure against the second nip roller under the force of the spring.

13. The inflatable-cushion inflation and sealing device of claim 11, wherein the pivot point is positioned such that rotation of the first nip roller lever about the pivot point moves the first nip roller generally tangentially relative to the second pinch area with the third nip roller.

14. The inflatable-cushion inflation and sealing device of claim 13, wherein the first nip roller lever engages a third nip roller lever such that as the first nip roller lever rotates moving the first nip roller away from the second nip roller, the first nip roller lever causes the third nip roller lever to rotate such that the third nip roller moves away from the second pinch area.

15. The inflatable-cushion inflation and sealing device of claim 14, wherein the third nip roller lever includes a notch having a surface that engages the first nip roller lever such that forces from the first nip roller lever against the notch surface causes the third nip roller lever to rotate.

16. The inflatable-cushion inflation and sealing device of claim 15, wherein the third nip roller axis is positioned between the notch and the third nip roller lever pivot.

17. The inflatable-cushion inflation and sealing device of claim 1, wherein the sealing mechanism is beltless.

18. The inflatable-cushion inflation and sealing device of claim 1, further comprising a cover that covers one or more of the first, second, or third rollers and provides a slot operable to redirect the flexible structure after the flexible structure exits the second pinch area.

19. The inflatable-cushion inflation and sealing device of claim 1, wherein the heating element heats the film at the first pinch location.

20. The inflatable-cushion inflation and sealing device of claim 19, wherein the heating element supplies sufficient heat at the first pinch area to seal the material.

21. The inflatable-cushion inflation and sealing device of claim 20, wherein the heating element is stationary.

22. An inflatable-cushion inflation and sealing device, comprising:

an inflation assembly that inflates a cushion cavity disposed between overlapping portions of first and second plies of a film with a fluid, wherein the plies cooperatively form a flexible structure; and a sealing mechanism comprising:

a first compression element having a curved surface operable to bend the flexible structure thereabout;

a second compression element positioned against the first compression element to pinch the flexible structure therebetween at a first pinch area;

a third compression element positioned against the first compression element to pinch the flexible structure therebetween at a second pinch area downstream of the first pinch area, and a heating element disposed adjacent to the first compression element and second compression element;

wherein the first compression element is adjustable relative to the second compression element and the third compression element is adjustable relative to the first compression element, and wherein the first compression element engages the third compression element such that as the first compression element is adjusted away from the second compression element, the third compression element is automatically moved away from the first compression element.

23. The inflatable-cushion inflation and sealing device of claim 22, wherein the first, second, and third compression elements are first, second, and third nip roller assemblies having first, second, and third nip rollers, respectively, with the third nip roller being positioned on a third nip roller lever having a pivot point positioned at a location different than the axis of rotation of the third nip roller, with the pivot point positioned such that rotation of the lever about the pivot point moves the third nip roller toward or away from the first nip roller.

24. The inflatable-cushion inflation and sealing device of claim 23, wherein the third nip roller lever is spring loaded such that the third nip roller lever biases the third nip roller toward the first nip roller such that the third nip roller is operable to compress the flexible structure against the first nip roller under the force of the spring.

25. The inflatable-cushion inflation and sealing device of claim 23, wherein the first nip roller is positioned on a first nip roller lever having a pivot point positioned at a location different than the axis of rotation of the first nip roller, with the pivot point positioned such that rotation of the first nip roller lever about the pivot point moves the first nip roller toward or away from the second nip roller.

26. The inflatable-cushion inflation and sealing device of claim 23, wherein the first nip roller lever is spring loaded such that the first nip roller lever biases the third nip roller toward the second nip roller such that the first nip roller is operable to compress the flexible structure against the second nip roller under the force of the spring.

27. The inflatable-cushion inflation and sealing device of claim 26, wherein the pivot point is positioned such that rotation of the lever about the pivot point moves the first nip roller generally tangential to the pinch area with the third nip roller.

28. The inflatable-cushion inflation and sealing device of claim 25, wherein the third nip roller lever includes a notch having a surface that engages the first nip roller lever such that forces from the first nip roller lever against the notch surface causes the third nip roller lever to rotate and the third nip roller axis is positioned between the notch and the third nip roller lever pivot.

29. The inflatable-cushion inflation and sealing device of claim 23, wherein the first, second, and third nip rollers hold the flexible structure against the first nip roller along a cooling path between the first and second pinch areas with a surface of the film opposite from the first compression element free of contact with the sealing mechanism while the film is sufficiently retained against the first compression element to hold the fluid in the cushion cavity while the longitudinal seal cools.

30. The inflatable-cushion inflation and sealing device of claim 29, wherein the sealing mechanism is beltless.

* * * * *